US007214885B2

(12) United States Patent
Byerly

(10) Patent No.: US 7,214,885 B2
(45) Date of Patent: May 8, 2007

(54) LIQUID DISPENSING SYSTEM HAVING A MODULAR CORD SET

(75) Inventor: David J. Byerly, Lawrenceville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/953,167

(22) Filed: Sep. 29, 2004

(65) Prior Publication Data

US 2006/0065425 A1 Mar. 30, 2006

(51) Int. Cl.
*B67D 5/62* (2006.01)

(52) U.S. Cl. ..... 174/135; 222/146.5

(58) Field of Classification Search ..... 174/135, 174/71 R; 222/146.5
See application file for complete search history.

(56) References Cited

U.S. PATENT DOCUMENTS

| | | | | |
|---|---|---|---|---|
| 4,957,783 | A | 9/1990 | Gabryszewski | 427/424 |
| 5,375,738 | A | 12/1994 | Walsh et al. | 222/1 |
| 5,535,919 | A | 7/1996 | Ganzer et al. | 222/1 |
| 5,791,531 | A | 8/1998 | Hassler, Jr. | 222/504 |
| 5,887,757 | A | 3/1999 | Jenkins et al. | 222/146.2 |
| 6,089,413 | A | 7/2000 | Riney et al. | 222/318 |
| 6,499,629 | B1 * | 12/2002 | Colangelo et al. | 222/61 |
| 6,520,382 | B2 | 2/2003 | Estelle et al. | 222/146.1 |
| 6,814,315 | B2 | 11/2004 | Gould et al. | 239/587.1 |
| 2004/0011817 | A1 | 1/2004 | Colangelo et al. | 222/146.5 |
| 2004/0055739 | A1 | 3/2004 | Suckow et al. | 165/104.33 |
| 2004/0084474 | A1 | 5/2004 | Gabryszewski | 222/1 |
| 2004/0084486 | A1 | 5/2004 | Raterman et al. | 222/529 |
| 2004/0217216 | A1 | 11/2004 | Ganzer | 239/589 |

* cited by examiner

*Primary Examiner*—Jinhee Lee
(74) *Attorney, Agent, or Firm*—Wood, Herron & Evans LLP

(57) ABSTRACT

A liquid dispensing system equipped with a modular cord set for powering an electrically-operated dispensing module of the system. The cord set includes a plug removably inserted into receptacle extending through a manifold of the system. The manifold heats and supplies liquid to the dispensing module. When the plug is positioned in the receptacle, electrical contacts on the plug are coupled with corresponding electrical contacts on the dispensing module. The cord set and dispensing module can be independently disconnected from the manifold without disturbing each other.

14 Claims, 3 Drawing Sheets

LIQUID DISPENSING SYSTEM HAVING A MODULAR CORD SET

FIELD OF THE INVENTION

The invention generally relates to dispensing apparatus for dispensing flowable materials and, more particularly, to electrically-operated dispensing modules for dispensing viscous liquids like hot melt adhesives.

BACKGROUND OF THE INVENTION

Electrically-operated dispensing modules have been developed for product assembly lines requiring precise and intermittent placement of small amounts of a viscous liquid, such as heated hot melt adhesives, at a high speed onto a substrate. Generally, electrically-operated dispensing modules include an electromagnetic coil, a magnetic pole piece, a magnetic armature movable relative to the pole piece, and a valve stem operatively coupled for cyclic movement with the armature. Selectively energizing and de-energizing the electromagnetic coil moves the armature relative to the pole piece. When energized to initiate a dispensing cycle, the electromagnetic coil produces an electromagnetic field that magnetizes the armature and pole piece. The resulting attractive force moves the armature toward the pole piece, which disengages or unseats the valve stem from a valve seat and opens the dispensing module. When the electromagnetic coil is de-energized, the magnetization of the armature and pole piece rapidly dissipates, which discontinues the attractive force. A return spring biases the armature away from the pole piece to reestablish contact between the valve stem and valve seat and closes the dispensing module.

Electrically-operated dispensing modules are frequently used to dispense viscous liquids that are maintained at elevated temperatures to ensure proper flow characteristics and dispensability. The dispensing module is typically not directly heated but, instead, is coupled to a manifold with a thermally-conductive contact. The manifold is typically heated by an electric heating element and a resistive temperature detector (RTD) provides a feedback loop to a controller for regulating the manifold temperature. By maintaining the manifold and the liquid resident inside the manifold at an appropriate temperature, the dispensing module is also heated by thermal conduction.

The electromagnetic coil, the RTD, and the heating element are connected electrically by conductors in a cord set with the controller of the dispensing system for operation. Conventional electrical connections are hard-wired connections, which are cumbersome when assembling and disassembling the dispensing module from the manifold and when engaging and disengaging the cord set from the manifold. It follows that such conventional hard-wired electrical connections slow service and repair procedures.

Accordingly, there is a need for an electrical connector that simplifies the connection and disconnection of the dispensing module from the manifold, and simplifies connecting and disconnecting the cord set from the assembled dispensing module and manifold.

SUMMARY OF INVENTION

In accordance with an embodiment of the invention, a dispensing system comprises a manifold having a first face, a second face opposite the first face, and a receptacle extending between the first and second faces. Removably mounted to the first face of the manifold is an electrically-operated dispensing module that includes a plurality of first electrical contacts accessible through the receptacle. The dispensing system further includes a cord set having a plug with a plurality of second electrical contacts. The plug is removably received within the receptacle through said second face and positioned such that each of the second electrical contacts is electrically coupled with a corresponding one of the first electrical contacts.

In another aspect of the invention, a cord set is provided for a dispensing system including a manifold and an electrically-operated dispensing module mounted to the manifold. The cord set includes a cable carrying a plurality of electrical conductors, a face plate adapted for mounting to the manifold, and a support arm including a first end attached to the face plate, a second end, and a shoulder positioned between the first and second ends. The face plate includes an opening for passage of the electrical conductors and the support arm projects substantially transverse to the face plate. The cord set further includes a plug coupled with the support arm. The plug has a plurality of electrical contacts each electrically coupling one of the electrical conductors with the electrically-operated dispensing module. The plug contacts the shoulder on the support arm to define a position for the plug relative to the second end of the support arm.

The present invention promotes quick and easy removal and replacement of a cord set from an assembled manifold and module. Because of the modularity in design, the module is easily separated from the manifold without disconnecting the cord set. As a result, the dispensing system may be readily serviced in the field. The manifold is provided with a receptacle that permits an electrical connector of the cord set to be easily engaged with, and disengaged from, the module and manifold. The modular design eliminates the hard wiring of these electrical connections found in conventional dispensing systems. Accordingly, the cord set and the manifold may be coupled and uncoupled by sliding a plug of the electrical connector relative to a receptacle defined in the manifold so that the contacts on the connector engage or disengage contacts on the module. The plug of the electrical connector itself is shaped to fit within the receptacle such that the electrical contacts on the plug are self-aligned with the electrical contacts on the module.

These and other objects and advantages of the present invention shall become more apparent from the accompanying drawings and description thereof.

BRIEF DESCRIPTION OF DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
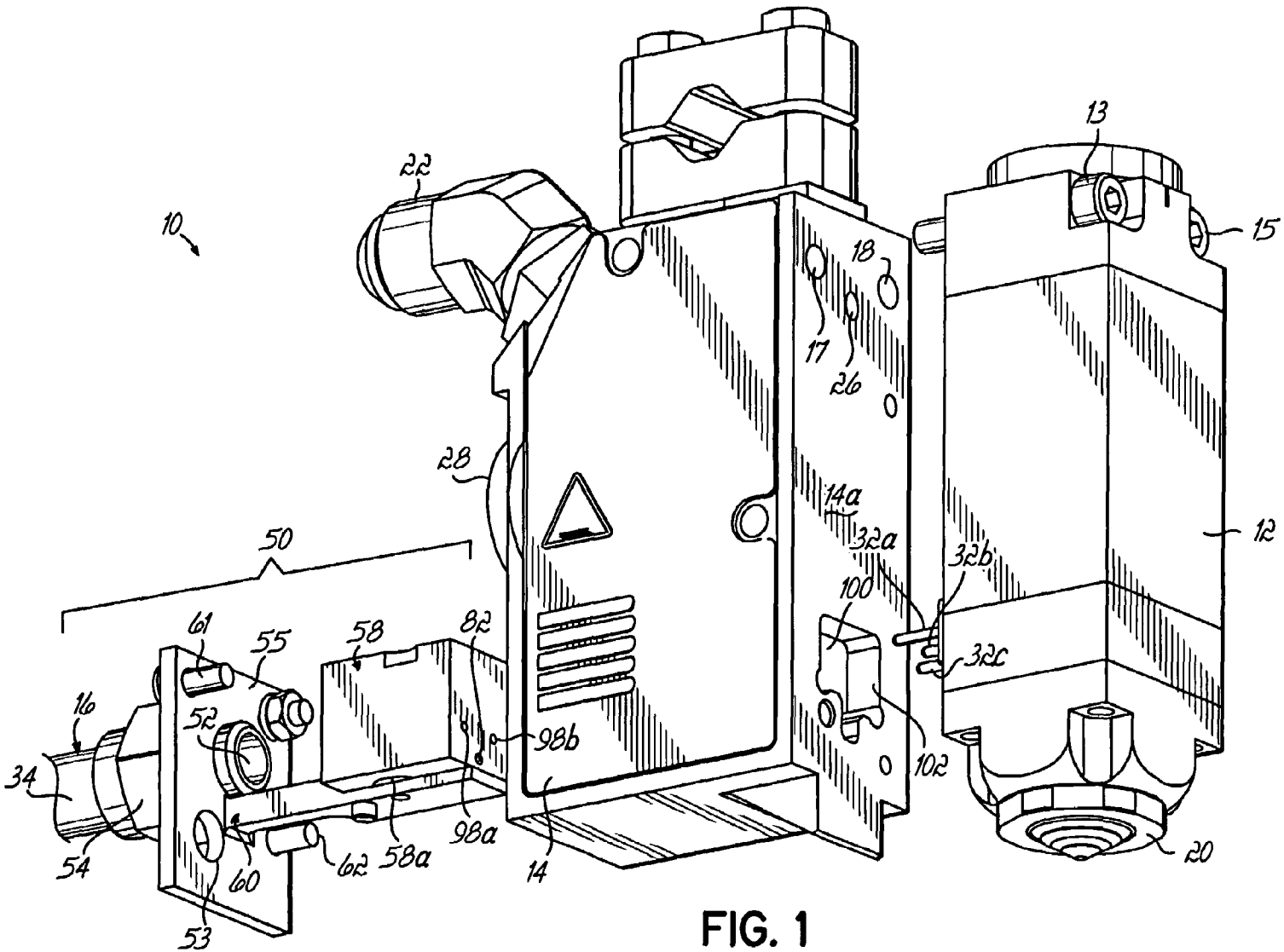
FIG. 1 is an exploded view of a liquid dispensing system in accordance with the present invention in which the electrical conductors are omitted for clarity.
Figure 2:
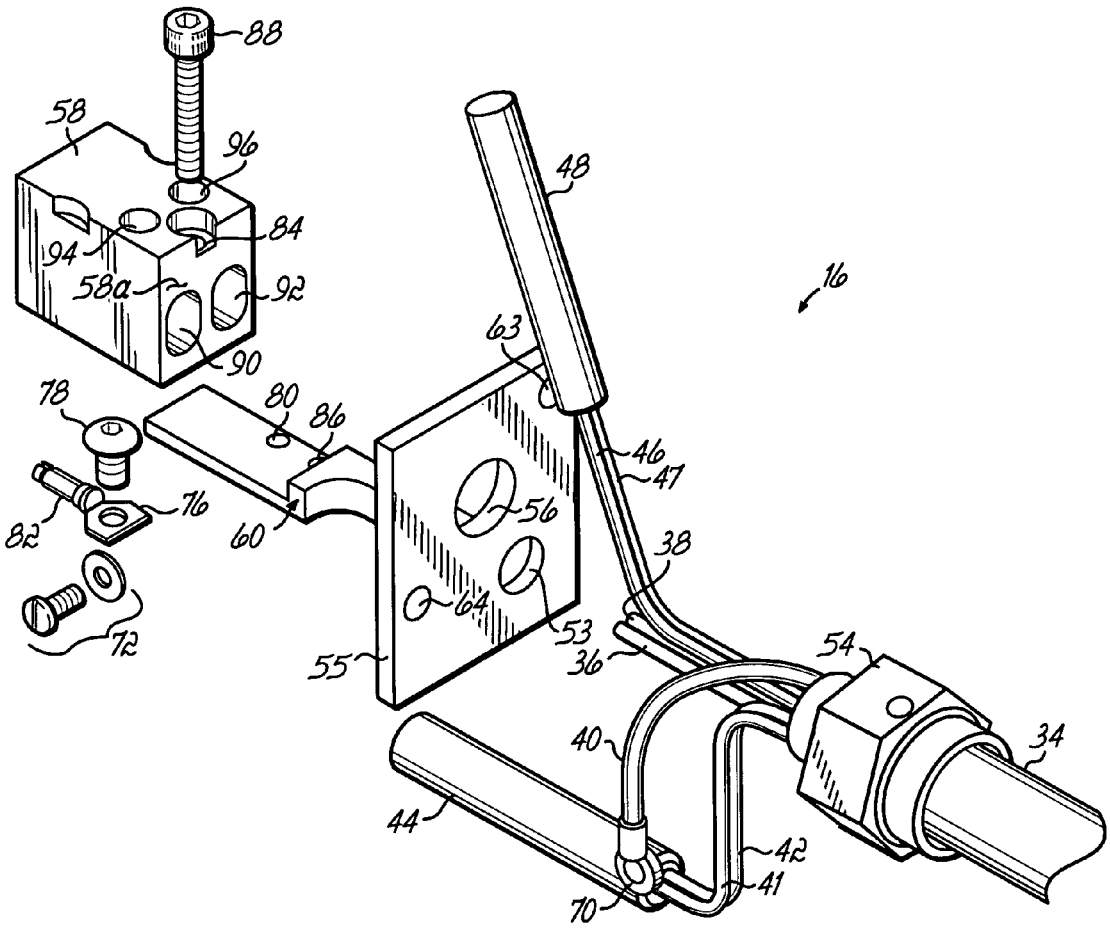
FIG. 2 is an exploded view of the cord set, plug, and mounting bracket of FIG. 1.

With reference to FIGS. 1 and 2, a liquid dispensing system 10 includes an electrically-operated gun or dispensing module 12, a manifold 14, and a cord set 16 extending to a controller (not shown). The cord set 16 includes an electrical connector (not shown) that physically and electrically couples with the cord set 16 with the controller. The module 12 may be physically connected with the manifold 14 in a variety of ways. For example, as shown in FIG. 1, two bolts 13, 15 are fastened into threaded openings 17, 18 of the manifold 14. Another bolt (not shown) extends through a countersunk clearance hole 19 extending through the module 12 and fastens into a threaded opening (not shown) having an entrance on the face of the module 12 confronting the manifold 14. As known to one of ordinary skill, the liquid dispensing system 10 of FIG. 1 may be used to dispense hot melt adhesive, paints, inks, other adhesives, as well as a variety of other liquids.

The module 12, manifold 14, and cord set 16 are operatively coupled together for controllably dispensing amounts of liquid supplied to a cavity defined inside the module 12 from a nozzle 20. The manifold 14 includes a fitting 22, which is disposed in a bore 24 (FIG. 4), that is adapted to couple with a fluid hose (not shown) supplying liquid from an external source (not shown). As conventionally known, liquid enters the manifold 14 and exits through a passageway 26 for delivery to the module 12. Bore 30 (FIG. 4) in manifold 14 may receive a filter element 28 (FIG. 1) for filtering liquid flowing from bore 24 to passageway 26.

The module 12 includes a plurality of electrical contacts 32*a–c*, which are illustrated in the preferred embodiment of FIG. 1 as posts or pins. The electrical contacts 32*a–c* define conductive elements electrically coupled with an electromagnetic coil (not shown) disposed inside the module 12. For a typical single-coil module 12, two of the electrical contacts 32*a,b* are used to connect to the electromagnetic coil and one electrical contact 32*c* provides a ground, or neutral, reference. If multiple coils are present within the module 12, then an additional pair of electrical contacts (not shown) is provided for each additional coil.

With reference to FIG. 2, the cord set 16 includes a cable 34 containing a pair of coil wires 36, 38, a ground strap 40, a pair of wires or conductors 41, 42 coupled with a heating element 44, and a pair of wires or conductors 46, 47 coupled with a temperature sensor 48, such as a nickel or platinum resistance temperature device (RTD). The ground strap 40 is coupled with an extension of a flexible tubular sheath, typically formed from a metal wire braid, extending the length of the cable 34 and surrounding the coil wires 36, 38 and conductors 41, 42, 46, 47. The coil wires 36, 38, ground strap 40, and conductors 41, 42, 46, 47 are coupled at their respective opposite ends (not shown) with a controller (not shown) operative to drive the dispensing module 12 and heat the manifold 14. When an electrical connector assembly 50 of cord set 16 is assembled, the coil wires 36, 38, ground strap 40, and conductors 41, 42, 46, 47 emerge from a central opening 52 defined in a ferrule connector 54 that terminates cable 34.

Figure 3:
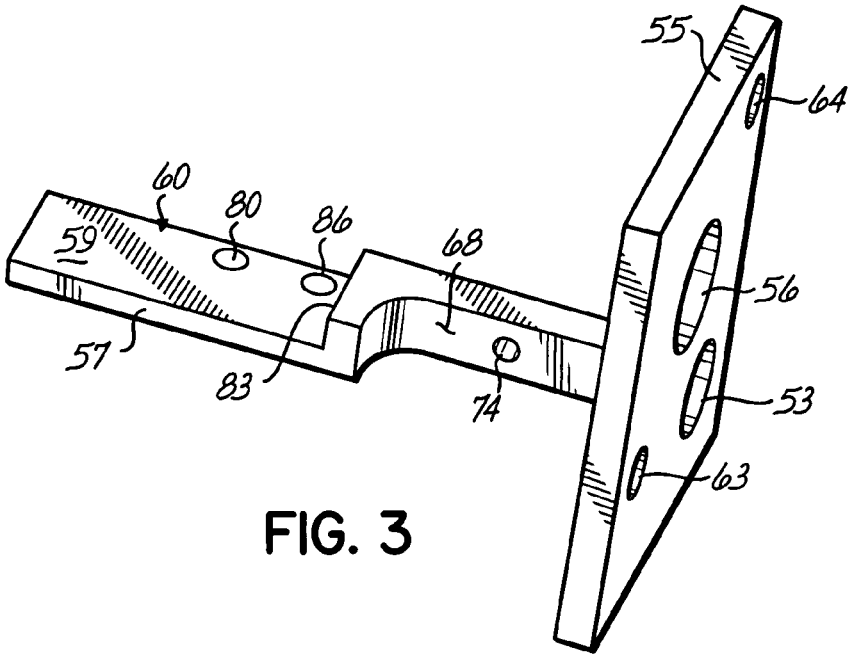
FIG. 3 is a perspective view of the mounting bracket of FIG. 2.

With reference to FIGS. 1–3, the electrical connector assembly 50 consists of a connector block or plug 58 and a mounting bracket 60 having an arm 57 that physically supports the plug 58. The plug 58 is formed from a non-conductive material (i.e., an electrical insulator), such as polytetrafluoroethylene (PTFE), the homopolymer of tetrafluoroethylene sold under the trademark TEFLON by DuPont. The mounting bracket 60 further includes a face plate 55 fastened to the manifold 14 by threaded fasteners 61, 62 (FIG. 1) extending through openings 63, 64 (FIG. 2) and engaging threaded bolt holes 65, 66 (FIG. 4) provided in manifold 14. The ferrule connector 54 is secured to an opening 56 defined in the face plate 55. Arm 57 projects away from one face of the face plate 55 and, when mounted to the manifold 14, projects away from the rear manifold face 14*b*. Face plate 55 includes an access opening 53 for tightening and loosening the bolt (not shown) extending through clearance hole 19 (FIG. 4) in the module 12, so that the module 12 can be removed from manifold 14 without detaching the electrical connector assembly 50 from manifold 14.

The mounting bracket 60, which is fabricated from an electrically conductive material, has a first ground connecting region 68 (FIG. 3) on arm 57 that is coupled with a lug 70 terminating the ground strap 40 of cable 34. For example, a fastener 72 (FIG. 2) is passed through a clearance opening defined in the lug 70 and screws into a threaded opening 74 of the ground connecting region 68.

Another lug 76 is connected to an upper side of the arm 57 of mounting bracket 60 by a fastener 78 threaded into a threaded opening 80. When connected in this manner, the ground strap 40, bracket 60 and lug 76 are all electrically coupled to provide a common ground. Lug 76 includes an electrical contact 82, illustrated as a socket, shaped to receive electrical contact 32*c* of dispensing module 12, thereby grounding dispensing module 12. The lug 76 and the head of fastener 78 are positioned between the plug 58 and the mounting bracket 60. Accordingly, the plug 58 has a cavity or indentation 58*a* in its underside shaped to accommodate the lug 76 and the head of fastener 78. When assembled, the indentation 58*a* faces toward arm 57 and is positioned between arm 57 and plug 58. The lug 76 contacts a second grounding region 59 on the arm 57.

The arm 57 of bracket 60 also includes a shoulder 83 that aids in properly placing the plug 58 on the bracket 60. For example, when a face 58*a* of the plug 58 is placed adjacent to the shoulder 83, a throughhole 84 in the plug 58 aligns with a threaded opening 86 in arm 57 thereby allowing a fastener 88 to pass for fastening the plug 58 and mounting bracket 60 together. The stop location defined by shoulder 83 also assists in correctly positioning the plug 58 within the manifold 14 for establishing connections with the electrical contacts 32*a–c* of the module 12. Specifically, the position of the shoulder 83 on arm 57 and the length of arm 57 are selected such that the contacts 82, 98*a,b* of plug 58 are positioned proximate to a front manifold face 14*a* (FIG. 1) at a location accessible for electrically coupling the plug 58 with the module 12. Contact 82, which represents a ground contact for the module 12, is typically positioned within plug 58 so that the corresponding contact 32*c* on module 12 is the first to contact when the module 12 and plug 58 are connected and the last to break when the module 12 and plug 58 are disconnected.

Openings 90 and 92 defined in plug 58 receive a respective one of the coil wires 36, 38. Within the plug 58, fasteners (not shown) are provided for securing the coil wires 36, 38 to a portion of respective electrical contacts 98*a,b* (FIG. 1) located inside the plug 58. For example, a screw-type clamp may be used such that the ends of coil wires 36, 38 are inserted into the respective openings 90 and 92 and then the clamps are tightened through access holes 94 and 96 to electrically couple contacts 98*a,b*, illustrated as sockets, with the coil wires 36, 38. Hence, when the cord set 16 is electrically coupled with module 12 and mechanically coupled with the manifold 14, electrical contacts 98*a,b* are coupled with contacts 32*a,b* for electrically coupling the coil wires 36, 38 with the coil inside module 12.

Figure 4:
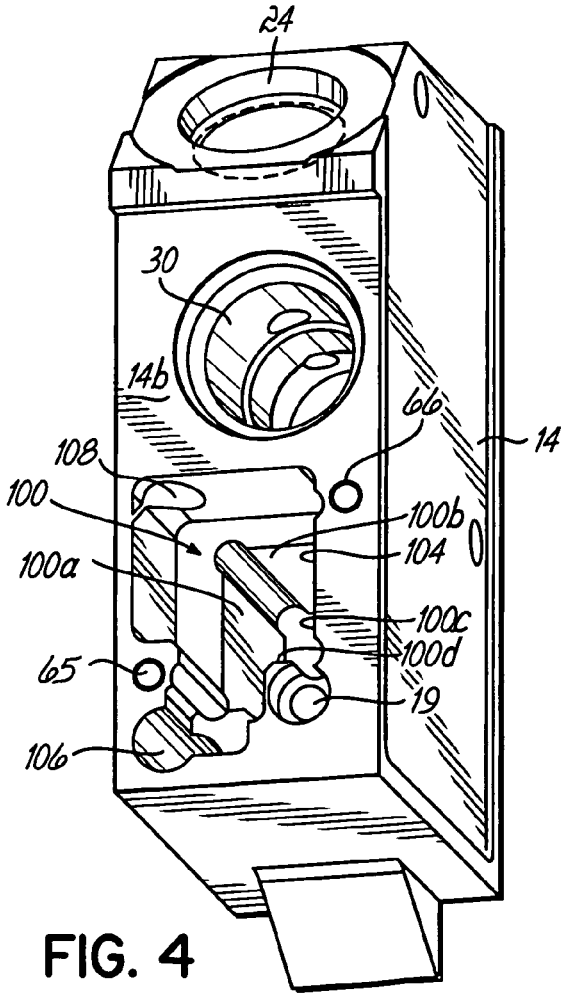
FIG. 4 is a perspective view of the side of the manifold of FIG. 1 to which the cord set is attached.

With reference to FIG. 4, the manifold 14 includes a receptacle 100 extending from an opening 102 defined in a front manifold face 14*a* (FIG. 1) to an opening 104 defined in rear manifold face 14*b*. The plug 58 and the mounting bracket 60 slide into the receptacle 100 until the face plate 55 abuts the rear manifold face 14*b*. The receptacle 100 is preferably shaped and sized such that sidewalls 100*a–d* guide the plug 58 into proper alignment with the opening 102 on the front manifold face 14*a*. The receptacle 100 has a rectangular cross-section profile when viewed along a direction extending between the first and second faces 14*a,b*. The plug 58 has a cross-sectional profile similar to that of the receptacle 100. In addition to the straight wall design depicted in FIG. 2, the sidewalls 100*a–d* of the receptacle 100 may be keyed or otherwise shaped to add additional means for properly, and automatically, aligning the plug 58.

The receptacle 100 includes a blind bore 106 dimensioned for accepting the heating element 44 and another blind bore 108 dimensioned for accepting the temperature sensor 48. The bores 106, 108 are dimensioned such that the corresponding one of the heating element 44 and temperature sensor 48 have a fit that promotes efficient heat transfer with the manifold 14. The heating element 44 maintains the liquid in the manifold 14 at a dispensable temperature and the temperature sensor 48 provides a feedback loop to a controller for regulating the power supplied to the heating element 44.

In use and with reference to FIGS. 1–4, the module 12 is physically connected with face 14*a* of manifold 14 using bolts 13, 15. The plug 58 of the electrical connector assembly 50 is inserted into the receptacle 100 until the face plate 55 of the mounting bracket 60 contacts the rear face 14*b* of manifold 14. The sidewalls 100*a–d* guide the plug 58 into proper alignment with the opening 102 on the front manifold face 14*a*. Electrical contacts 98*a,b* and 82 of plug 58 are placed into electrical contact with electrical contacts 32*a–c* of module 12 when the plug 58 is fully received in receptacle 100. As a result, the wires from the cord set 16 are connected to the plug 58, which in turn has electrical contacts 98*a,b* and 82 supplying electrical connections with electrical contacts 32*a–c*. Electrical contacts 32*a,b* and 98*a,b* are electrically coupled by plug 58 for powering the coil (not shown) of the dispensing module 12 and electrical contacts 32*c* and 82 are electrically coupled to define a ground connection. The face plate 55 is then mounted to the opposite face 14*b* of manifold 14 by fastening the face plate 55 of mounting bracket 60 to the manifold 14 with threaded fasteners 61, 62.

The module 12 and the cord set 16 are independently removable from the manifold 14. The cord set 16 is detached from manifold 14 by removing threaded fasteners 61, 62 and sliding the plug 58 out of the receptacle 100. Although the electrical contacts 98*a,b* and 82 are separated from electrical contacts 32*a–c*, the attachment of the module 12 to the manifold 14 is unaffected. The module 12 is detached from manifold 14 by removing bolts 13, 15 and manually moving the module 12 in a direction away from the manifold 14. This separates electrical contacts 98*a,b* and 82 from electrical contacts 32*a–c*, thereby breaking the electrical connection between the module 12 and the cord set 16, without affecting the attachment of the cord set 16 to the manifold 14.

For purposes of this description, words such as "vertical", "horizontal", "bottom", "right", "left" and the like are applied in conjunction with the drawings for purposes of clarity. As is well known, liquid dispensing systems may be oriented with substantially any orientation, so these directional words should not be used to imply any particular absolute reference frame.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein I claim:

1. A dispensing system comprising:

a manifold having a first face, a second face opposite said first face, and a receptacle extending between said first and second faces;

an electrically-operated dispensing module removably mounted to said first face of said manifold and including a plurality of first electrical contacts accessible through said receptacle; and a cord set including a plug with a plurality of second electrical contacts, said plug removably received within said receptacle through said second face and positioned such that each of said second electrical contacts is electrically coupled with a corresponding one of said first electrical contacts.

2. The dispensing system of claim 1 wherein said cord set includes a mounting bracket supporting said plug, said mounting bracket being removably mounted to said second face of said manifold.

3. The dispensing system of claim 2 wherein said mounting bracket includes a shoulder in contact with said plug for defining a location of said plug relative to said receptacle effective for electrically coupling said first and second electrical contacts.

4. The dispensing system of claim 2 wherein said mounting bracket includes a face plate removably mounted to said second face of said manifold and a support arm projecting from said face plate into said receptacle, said support arm having a first end attached to said face plate and a second end carrying said plug.

5. The dispensing system of claim 2 wherein said mounting bracket is formed from an electrically conductive material, said cord set includes a ground strap attached to said mounting bracket, and one of said first electrical contacts is attached to said mounting bracket for defining a ground connection with said dispensing module.

6. The dispensing system of claim 1 wherein said cord set includes a cable with a plurality of first electrical conductors, each of said first electrical conductors electrically coupled with one of said second electrical contacts, and said cable mechanically coupled with said plug.

7. The dispensing system of claim 6 wherein said cord set further includes a heating element and a temperature sensor, said cable further includes a plurality of second electrical conductors coupled with said heating element and said temperature sensor, and said manifold is adapted to receive said heating element and said temperature sensor.

8. The dispensing system of claim 1 wherein said receptacle includes a plurality of guide surfaces contacting said plug, said guide surfaces cooperating to position said second electrical contacts for electrical coupling with said first electrical contacts.

9. The dispensing system of claim 1 wherein said plug is inserted into said receptacle such that said second electrical contacts are accessible on said first face of said manifold for electrically coupling with said first electrical contacts of said dispensing module.

10. The dispensing system of claim 1 wherein said receptacle has a cross-section profile when viewed along a direction extending between said first and second faces, and said plug has a cross-sectional profile similar to said receptacle.

11. The dispensing system of claim 1 wherein said plug is removable from said receptacle without removing said dispensing module from said manifold.

12. The dispensing system of claim 1 wherein said dispensing module is removable from said manifold without removing said plug from said receptacle.

13. The dispensing system of claim 1 wherein said dispensing module is mounted to said manifold by a first plurality of fastening elements and said cord set is mounted to said second face of said manifold by a second plurality of fastening elements independent of said first fastening elements.

14. The dispensing system of claim 1 wherein said first electrical contacts comprise male pins and said second electrical contacts comprise female sockets each adapted to receive one of said male pins.

* * * * *